United States Patent [19]

Conley

[11] 4,026,381

[45] May 31, 1977

[54] EXHAUST SYSTEM COVER ASSEMBLY

[75] Inventor: Challie Conley, Fountain Valley, Calif.

[73] Assignee: Hallamore Inc., Fountain Valley, Calif.

[22] Filed: Sept. 15, 1975

[21] Appl. No.: 613,630

[52] U.S. Cl. ..... 181/62; 181/33 K; 181/36 B; 181/42

[51] Int. Cl.[2] ..... F01N 7/16

[58] Field of Search ..... 181/62, 61, 33 K, 36 B, 181/42, 50

[56] References Cited

UNITED STATES PATENTS

| | | | |
|---|---|---|---|
| 2,504,421 | 4/1950 | Johnson et al. | 181/62 |
| 2,756,172 | 7/1956 | Kidd | 181/62 |
| 3,087,578 | 4/1963 | Reed et al. | 181/33 K |
| 3,233,699 | 2/1966 | Plummer | 181/62 |
| 3,488,723 | 1/1970 | Veazie | 181/62 |
| 3,491,849 | 1/1970 | Newkirk | 181/62 |

*Primary Examiner*—Stephen J. Tomsky
*Attorney, Agent, or Firm*—Jackson & Jones Law Corporation

[57] ABSTRACT

The present invention provides a cover assembly for an exhaust muffler and tail pipe to reduce noise and eliminate corrosion. The cover assembly is advantageously formed from a pair of molded rigid fiber glass shells that can be fastened together about both the exhaust pipe and the muffler. Sandwiched about the muffler and exhaust pipe shells are layers of asbestos and spun glass. The shell itself is a combination of a fire retardant resin and fiber glass. The exhaust covering is particularly valuable in diesel exhaust systems for trucks.

4 Claims, 3 Drawing Figures

EXHAUST SYSTEM COVER ASSEMBLY

BACKGROUND OF THE INVENTION

1. Field of the Invention

The present invention is directed to exhaust systems and more particularly to a corrosion resistant sound deadening exhaust system.

2. Description of the Prior Art

It is well known in the prior art that the exhaust system of a truck or motor vehicle is frequently subject to failure before other components of the drive system. The exhaust systems are generally exposed to the environment and since they function at elevated temperatures, they are particularly susceptive to corrosion. Generally, most exhaust systems utilize metallic pipes and shells and are susceptible to transmission of exhaust noise to the atmosphere.

The Environmental Protection Agency has recently suggested noise control regulations, that restrict the decibels that a truck can produce. For example, EPA regulations have been proposed, which will require interstate trucks to meet a maximum noise level, when measured at a distance of 50ft, of 90 decibels at speeds of thirty five miles per hour or less, 88 decibels at speeds over thirty five miles per hour and 86 decibels during a stationary engine run up test. Further, proposed regulations will require new medium and heavy truck noise emissions to be held to seventy five decibels by 1983 with noise measurements being made at a distance of 50ft from the center line of a test track during a low speed, high acceleration test. It has been estimated that the cost involved in modifying a heavy duty diesel truck to meet these Environmental Protection Agency regulations will be greater than $1,000.00 per truck.

In addition to the Environmental Protection Agency's regulations, states have recently enacted relatively severe noise limitations both with regard to exterior noise and also with regard to the interior cab noise level for the operator.

Various attempts have been utilized in the prior art to limit noise in a truck, for example, manifold exhaust pipes have been wrapped in fiber glass and asbestos for quelling noise. The Plummer U.S. Pat. No. 3,233,699 discloses an exhaust gas muffler tail pipe assembly for a car that is wrapped in a fiberless insulating material with a flexible outer plastic skin.

The Audette U.S. Pat. No. 2,990,906 discloses an acoustical absorber wherein glass fiber is used in combination with a perforated cylinder to optimize the flow of a fluid medium with regards to the creation of turbulent noise. The Fairchild U.S. Pat. No. 844,669, Loomis U.S. Pat. No. 674,210 and Coles U.S. Pat. No. 929,656 are all cited of interest to disclose cylindrical muffler members having an outer steel or aluminim shell and an inner asbestos or mineral wool layer.

There is still a demand in the prior art to provide an effective but economically manufactured noise reduction system to limit the noise produced by a conventional truck engine.

SUMMARY OF THE INVENTION

The present invention provides a noise reducing and protective covering assembly that is capable of being attached to an exhaust system for a diesel engine and the like. The noise reducing covering assembly is adapted to cover both the exhaust conduit leading from the engine manifold and also the exhaust muffler itself. The protective covering assembly includes a pair of rigid fiber glass shells that can be readily mounted about the muffler and connected together to encapsule the muffler and the exhaust conduit within. The fiber glass shells are formed from a fire resistant resin and are used in combination with an asbestos wrap and spun fiber glass matting. The construction minimizes any reverberation shell ring which is secondary sound production by the exhaust conduit and muffler housing and is further capable of lowering the decibel level of a diesel engine by as much as 8 decibels.

The objects and features of the present invention which are believed to be novel are set forth with particularity in the appended claims. The present invention, both as to its organization and manner of operation, together with further objects and advantages thereof, may best be understood by reference to the following description, taken in conjunction with the accompanying drawings.

DESCRIPTION OF THE PREFERRED EMBODIMENT

Figures 1, 2, 3:
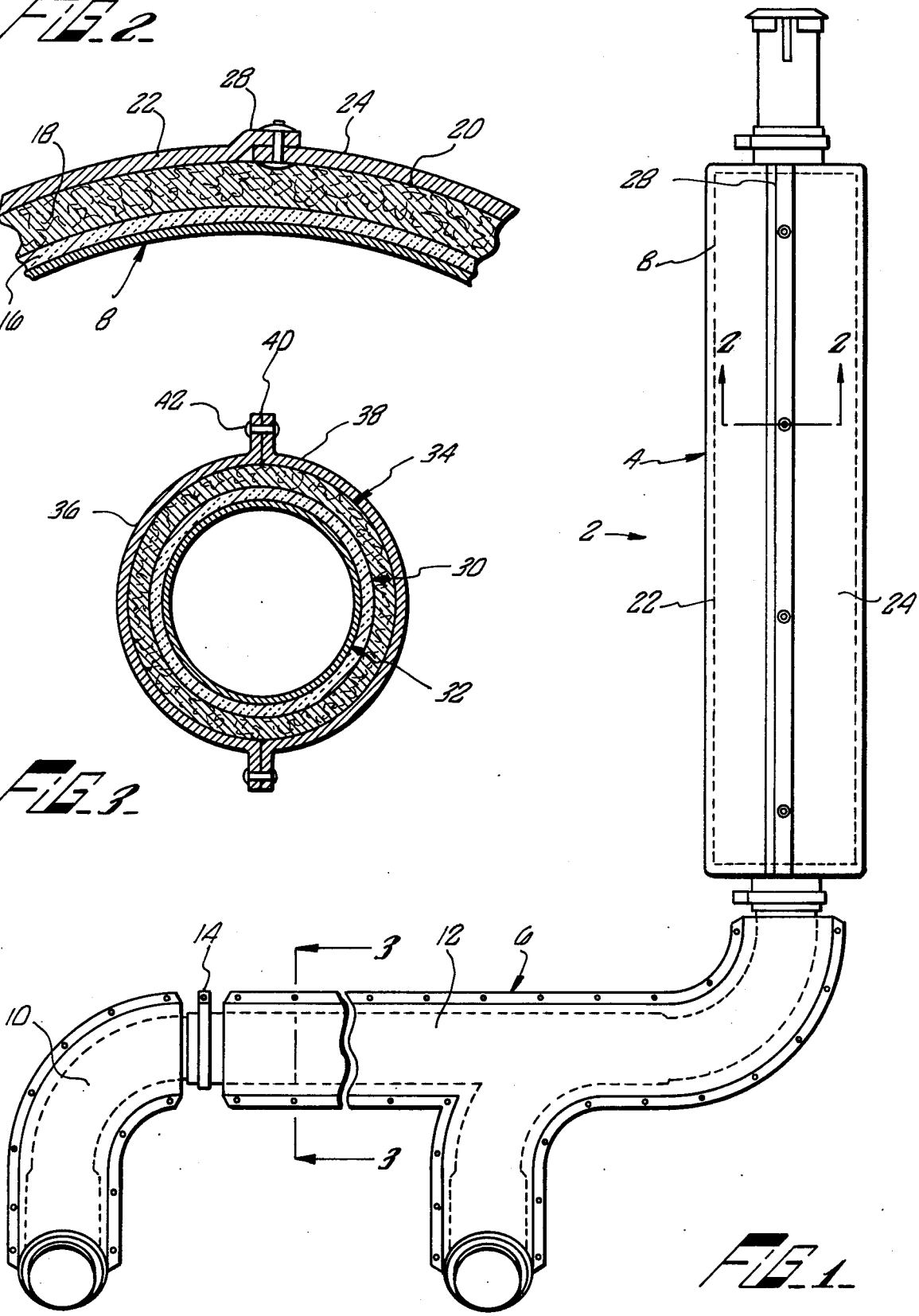
FIG. 1 is a planned view of the exhaust covering system of the present invention for a six cylinder diesel engine.
FIG. 2 is a partial cross sectional view taken along the line 2—2 of FIG. 1.
FIG. 3 is a cross sectional view of the exhaust conduit covering taken along the line 3—3 of FIG. 1.

The following description is provided to enable any person skilled in the designing of trucks to make and use the invention and sets forth the best mode contemplated by the inventor of carrying out his invention. Various modifications, however, will remain readily apparent to those skilled in the art, since the generic principles of the present invention have been defined specifically to provide a noise reducing exhaust covering system that can be manufactured in a relatively economical manner.

Referring to FIG. 1, a planned view of the corrosion resistant sound deadening system of the present invention. The particular exhaust system disclosed in FIG. 1 could be utilized on a Detroit Diesel 6V53 engine. Such an engine with a standard exhaust muffler such as a Donaldson muffler can create a noise level in the range of 86 decibels in a 50ft drive by test without the sound deadening exhaust system of the present invention. When the muffler and exhaust system is covered with the present invention, the noise level of the engine with the same running conditions and the same 50ft drive by test standards, will be in the range of 78 decibels. Thus, the present invention is capable of meeting the immediate noise regulations of any state or Federal Agency for the foreseeable future. The present invention has been found to be particularly successful for use on refuse trucks which are operated within residential areas.

As can be seen from FIG. 1, the sound deadening exhaust system 2 includes a rigid fiber glass muffler shell 4 and an exhaust conduit shell 6. In the illustrated embodiment, a nine inch outer diameter by 44 inch long heavy duty muffler 8 is enclosed by the muffler shell 4. The exhaust conduit shell 6 actually comprises a first 90° bend conduit shell 10 and an elongated conduit shell 12 which includes an extension for the left hand manifold. The components of the sound deadening exhaust system 2 is interconnected with clamps 14.

Referring to FIG. 2, a partial cross sectional view taken along the line A—A is provided of the muffler 8 and the muffler shell 4. The muffler 8 can be of any geometrical shape and is usually circular or oval. The muffler shell or housing is first wrapped with an asbestos layer having approximately a 95% asbestos fiber content and a 5% $Fe_2O_3$ content as a binder. The asbestos layer 16 is generally serviceable up to temperatures of approximately 800° F.

Wrapped about the abestos layer 16 is a fiber glass sheet that exhibits the properties of low thermal conductivity at temperatures up to 1200° F. This material can be commercially purchased from Johns-Manville as J-M Glass-Mat 1200 and has excellent vibration resistance and is noncombustible. In addition, the fiber glass layer 18 will not contribute to any metal corrosion nor will it absorb water. The material has a density of 11.3 lbs per cubic foot when applied but is compressed when the shells are attached. The fiber glass layer 18 can be held in place by a glass tape or duct tape 20 during its application.

The actual muffler shell 4 comprises a pair of identical molded fiber glass half shells 22 and 24. Each half shell is molded from a 60% fire retardant resin having 40% fiber glass fibers with a 10 to 15 mil. gel-coat surface. These shells are about ⅛ inch thick and have a density of 3 ozs. per square foot at that thickness. The material can be commercially bought from Koppers as No. 34635 fire retardant resin.

Aluminum or stainless steel pop rivets are used to interconnect the respective half shells 22 and 24. As can be seen from FIG. 2, an overlapping peripheral lip 28 is provided along one side of each molded half shell. As can be appreciated, the shells can be produced from the same mold and simply rotated 180° about a traverse axis to permit their complementary fastening together to form the hard rigid muffler shell 4 of the present invention. The design configuration of the molded half shells 22 and 24 are such to compress the fiber glass layer 18 during the assembly to provide the noise reduction exhaust system of the present invention.

Referring to FIG. 3, a similar form of construction is provided for the exhaust conduits 32. Again, a ⅛ inch thick asbestos wrap 30 is positioned about the exhaust conduit 32. Next, the fiber glass layer 34 is wrapped about the asbestos wrap 30 and can be held in place, for example, with a 2 inch duct tape. The rigid molded fiber glass conduit shell 6 actually comprises a pair of identical half shells 36 and 38 formed from the same fire retardant fiber glass laminated material as disclosed above with reference to the molded half shells 22 and 24. Each edge of the half shells 36 and 38 are provided with flanges 40 to permit their interconnection with aluminum or steel rivets 42.

The present invention not only muffles the primary engine exhaust sound but also helps dampen or prevent secondary sound production by the exhaust conduit housing and muffler housing. The secondary production is a reverberation shell ring. The fiber glass layers 18 and 34 are compressed to approximately one half their original size to aid in absorption of sound. The manufacturing of identical half shells for both the exhaust conduit 32 and for the muffler 8 provides an advantageous system that is both easily manufactured and eliminates inventory problems associated with alignment of parts. The fiber glass rigid exterior shells not only help dampen sound but further provide protection against road debris or minor contact with exterior objects during the operation of the truck vehicle. The flanges 40 on the exhaust conduit half shells 36 and 38 and the peripheral lip 28 on the muffler shell 4 are particularly advantageous to provide an easily assembled noise reduction exhaust system. Various modifications of the above embodiment are possible by one skilled in the truck design and art and accordingly the scope of the present invention should be measured from the following claims in which:

What is claimed is:

1. In an exhaust system for attachment to a diesel engine and the like having an exhaust conduit attached to the engine manifold and an exhaust muffler housing operatively attached to the conduit, the improvement comprising:

an asbestos sheet about the housing of the exhaust muffler having a density of at least .00044 pounds per cubic inch;

a fiberglass layer about the asbestos sheet having a density of at least 7.5 pounds per cubic foot; and cover means for reducing the exhaust sound produced by the engine including a pair of rigid fiberglass shells adapted to be mounted about the muffler and connected together to compress the fiberglass layer to surround the muffler, the shells including at least 60% of a fire retardant resin.

2. The invention of claim 1 wherein the fiberglass shells are identical.

3. The invention of claim 2 wherein one edge of each fiberglass shell is a peripheral lip extending outward of the convex surface of the remainder of the shell and is adapted to being fastened to the surface of the other matching fiberglass shell.

4. The invention of claim 3 wherein the cover means includes a pair of identical rigid fiberglass cover shells having fastening flanges adapted for securement of the cover shells together.

* * * * *